US010278441B2

(12) United States Patent
Schroeder

(10) Patent No.: US 10,278,441 B2
(45) Date of Patent: May 7, 2019

(54) EYELASH APPLICATION SYSTEM

(71) Applicant: Sandi Schroeder, Los Angeles, CA (US)

(72) Inventor: Sandi Schroeder, Los Angeles, CA (US)

( * ) Notice: Subject to any disclaimer, the term of this patent is extended or adjusted under 35 U.S.C. 154(b) by 238 days.

(21) Appl. No.: 14/936,255

(22) Filed: Nov. 9, 2015

(65) Prior Publication Data

US 2017/0150763 A1 Jun. 1, 2017

(51) Int. Cl.
*A41G 5/02* (2006.01)

(52) U.S. Cl.
CPC ..... *A41G 5/02* (2013.01)

(58) Field of Classification Search
CPC ..... A41G 5/02; A41G 5/0086; A41G 5/004–5/008; A41G 3/0006
USPC ..... 221/160, 164, 165, 190
See application file for complete search history.

(56) References Cited

U.S. PATENT DOCUMENTS 3,315,689 A * 4/1967 Melik ..... A41G 5/02 132/317
3,333,593 A 8/1967 McGivern
3,478,754 A * 11/1969 Martin, Jr. ..... A41G 5/02 132/216
3,654,939 A * 4/1972 Davidson ..... A45C 13/005 132/216
3,838,803 A 8/1974 Windsor
3,935,872 A 2/1976 Aylott
5,067,503 A * 11/1991 Stile ..... A61C 15/046 132/323
6,029,674 A 2/2000 Han
8,015,980 B2 9/2011 Rabe et al.
8,196,591 B2 * 6/2012 Lee ..... A41G 5/02 132/201
D669,223 S 10/2012 Lee et al.
8,424,542 B1 4/2013 Han
8,616,223 B2 12/2013 Rabe et al.
9,833,028 B2 * 12/2017 Jang ..... A41G 5/02
2010/0043816 A1 2/2010 Dix
2012/0000957 A1 1/2012 Martinez
2013/0042884 A1 2/2013 Wilkinson
2013/0133681 A1 5/2013 Chipman
2013/0160787 A1 6/2013 Chae et al.
2015/0201692 A1 * 7/2015 Hansen ..... A41G 5/02 132/201

FOREIGN PATENT DOCUMENTS

GB 1307107 * 12/1970
WO WO 2015116247 * 8/2015

* cited by examiner

*Primary Examiner* — Tatiana L Nobrega
*Assistant Examiner* — Brianne E Kalach
(74) *Attorney, Agent, or Firm* — White-Welker & Welker, LLC; Matthew T. Welker, Esq.

(57) ABSTRACT

A method and apparatus of an eyelash application system can include: a holder including a curved crossbar and a peg extending vertically past the curved crossbar; an eyelash strip attached to the curved crossbar of the holder; and an applicator having a top arm with a hole, the hole sized and position within the top arm to align and mate with the peg of the holder based on the applicator being in a loaded phase of operation.

11 Claims, 5 Drawing Sheets

EYELASH APPLICATION SYSTEM

CROSS-REFERENCE TO RELATED APPLICATIONS

This is a Continuation-In-Part of U.S. patent application Ser. No. 14/476,746 filed Sep. 4, 2014. The content of this application is incorporated in its entirety herein by reference.

TECHNICAL FIELD

This disclosure relates to systems and methods for personal care, more partially for handling, storing, and applying false eyelashes.

BACKGROUND

People around the world use products to enhance their appearance. All forms of cosmetics are used in the fashion, medical, and entertainment industries. False eyelashes and eyelash extensions are a commonly used technique for enhancing or augmenting the appearance of the eye.

Current methods for applying, storing, and handling false eyelashes present many problems that range from deleterious health consequences to difficulty in handling requiring a high degree of skill. Health consequences can result from the false eyelashes coming into contact with bacteria or other contagion eventually infecting the eye. This can happen when tools are improperly used or sanitized. This can also happen when an adhesive is applied in an unsanitary way.

Difficulty in applying false eyelashes can result from the awkward use of a delicate tweezer or even from attempting to apply the false eyelash with the naked finger tips. It is common for the false eyelash to be applied further from the base of the real eyelash than desirable, or with too much glue or adhesive.

Solutions have been long sought but prior developments have not taught or suggested any solutions that provide a comprehensive answer to these difficulties, and solutions to these problems have long eluded those skilled in the art. Thus there remains a considerable need for devices and methods that allow the application of false eyelashes in an easy intuitive way with minimal expertise or experience.

SUMMARY

An eyelash application system and methods, enabling the application of false eyelashes in an easy intuitive way with minimal expertise or experience are disclosed. The eyelash application system and methods can include: a holder including a curved crossbar and a peg extending vertically past the curved crossbar; an eyelash strip attached to the curved crossbar of the holder; and an applicator having a top arm with a hole, the hole sized and position within the top arm to align and mate with the peg of the holder based on the applicator being in a loaded phase of operation.

Accordingly many embodiments have been discovered to be useful in the health industry for allowing patients undergoing treatment, such as chemo therapy, to apply the eyelash strips even when they have never needed to before. Accordingly it has been discovered that one or more embodiments described herein can provide a natural intuitive solution allowing users to apply eyelash strips with minimal experience and minimal ability.

Other contemplated embodiments can include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE DRAWINGS

The eyelash application system is illustrated in the figures of the accompanying drawings which are meant to be exemplary and not limiting, in which like reference numerals are intended to refer to like components, and in which.

DETAILED DESCRIPTION

Figure 1:
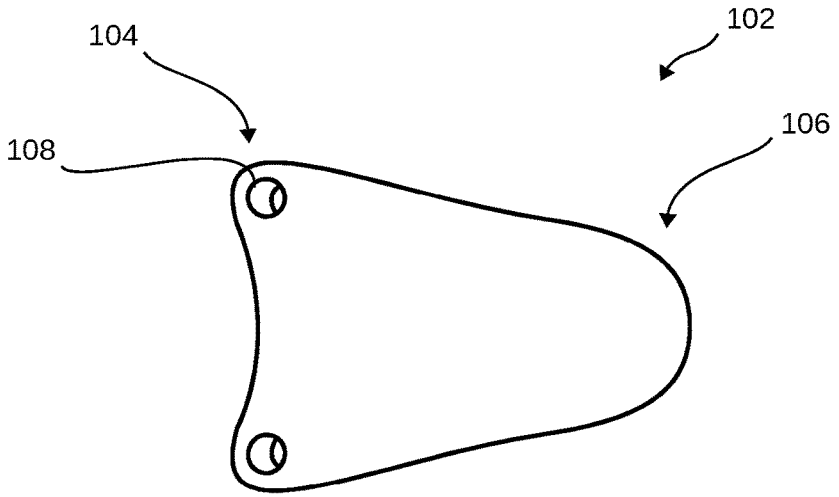
FIG. 1 is a top view of an applicator for an embodiment of the eyelash application system.

In the following description, reference is made to the accompanying drawings that form a part hereof, and in which are shown by way of illustration, embodiments in which the eyelash application system may be practiced. It is to be understood that other embodiments may be utilized and structural changes may be made without departing from the scope of the eyelash application system.

The eyelash application system is described in sufficient detail to enable those skilled in the art to make and use the eyelash application system and provide numerous specific details to give a thorough understanding of the eyelash application system; however, it will be apparent that the eyelash application system may be practiced without these specific details.

In order to avoid obscuring the eyelash application system, some well-known system configurations are not disclosed in detail. Likewise, the drawings showing embodiments of the system are semi-diagrammatic and not to scale and, particularly, some of the dimensions are for the clarity of presentation and are shown greatly exaggerated in the drawing FIGs. Generally, the eyelash application system can be operated in any orientation.

For expository purposes, the term "horizontal" as used herein is defined as a plane parallel to the bottom plane or bottom surface of the cartridge, regardless of its orientation. The term "vertical" refers to a direction perpendicular to the horizontal as just defined. Terms, such as "above", "below", "bottom", "top", "side", "higher", "lower", "upper", "over", and "under", are defined with respect to the horizontal plane. The term "system" means an apparatus or a method based on the context in which it is used.

Referring now to FIG. 1, therein is shown a top view of an applicator 102 for an embodiment of the eyelash application system. The applicator 102 is shown having a broad distal end 104 and a narrow proximal end 106.

The distal end 104 is depicted curved with a concave curve, to match the shape of a users eye and the eyelash strips (shown and described below). The distal end 104 can include holes 108. The holes 108 can be circumferentially closed through holes.

It has been discovered that providing the distal end having a large width and surface to handle reduces the skill requirement for use. The large width and surface allows the applicator 102 to be used by users with a lesser dexterity and allows users to fix multiple fingers along with the thumb on the applicator 102 during used and utilize the larger muscles of the arm and wrist allowing for greater controllability and stability which can result in safer and more precise operation.

The proximal end 106 is the end that is closer to a users wrist during operation while the distal end 104 is the end that is closer to a users eye during operation. The proximal end 106 can be formed with a smaller cross-section than the distal end 104 for greater mobility in the hand so that the distal end 104 can be held in a number of different positions within the hand.

Figure 2:
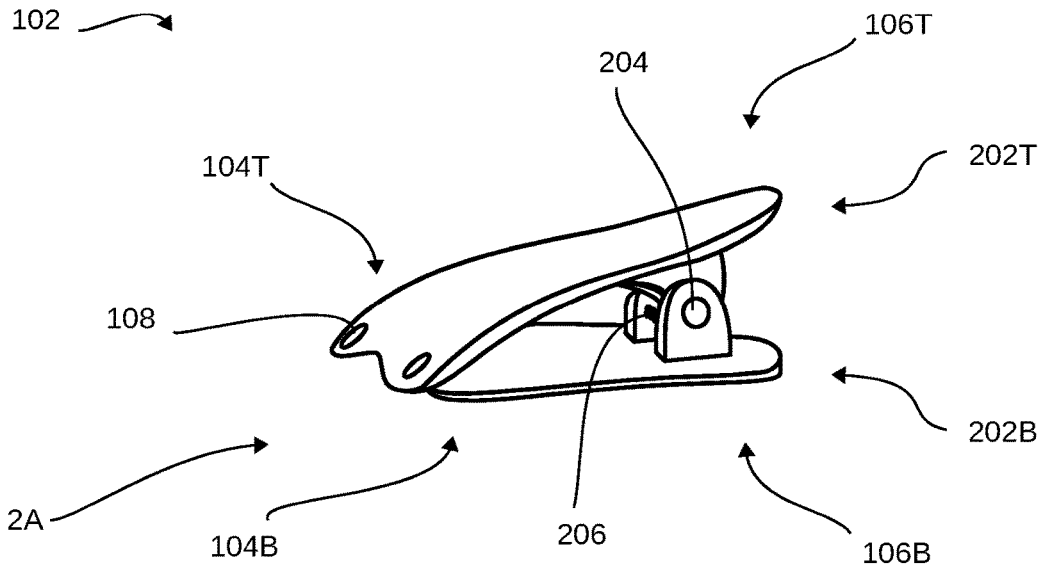
FIG. 2 is an isometric side view of the applicator of FIG. 1.

Referring now to FIG. 2, therein is shown an isometric side view of the applicator 102 of FIG. 1. For clarity when referring to the applicator 102 the reference suffix letters "T" and "B" will be appended to the reference numerals where needed to refer to elements of a top arm 202T and bottom arm 202B, respectively.

The top arm 202T is depicted with a distal end 104T and a proximal end 106T while the bottom arm 202B is depicted with a distal end 104B and a proximal end 106B. The holes 108 are shown formed within the top arm 202T. The top arm 202T and the bottom arm 202B are contemplated to be ridged or semi-rigid members and can be made of a polymer or metal.

The distal end 104T of the top arm 202T and the distal end 104B of the bottom arm 202B are shown converging toward each other. In this position the applicator 102 is in a closed position.

The applicator 102 can be opened by pressing the proximal end 106T and the proximal end 106B toward each other. The top arm 202T and the bottom arm 202B are connected with a hinge 204.

The hinge 204 can provide a fulcrum to allow the top arm 202T and the bottom arm 202B to pivot open and closed. A spring 206 can be used to maintain a closing force to keep the applicator 102 in the closed position. The force of the spring 206 may be overcome by a user's application of a pinching force on the proximal end 106T and the proximal end 106B.

The distal end 104T and the distal end 104B is depicted with a downward curve while the proximal end 106T is depicted as curving up away from the distal end 104B. The bottom arm 202B is shown as flat from the proximal end 106B to the distal end 104B.

Further the distal end 104T of the top arm 202T is shown having a thick cross-section that narrows toward the ends. The bottom arm 202B is depicted as having an even and uniform cross-section.

It has been discovered that the downward curve of the distal end 104T of the top arm 202T decreases the amount of skill required to use the applicator 102 by providing a natural intuitive shape that can be easily held and maneuvered in the hand. It has been discovered that the direction and shape of the curve of the distal end 104T help to provide an intuitive positioning of the applicator 102 near a user's eyelid when in use.

It has been further discovered that providing the proximal end 106T of the top arm 202T that curves away from the proximal end 106B of the bottom arm 202B also provides for better usability because the distal end 104T and the distal end 104B can be held with multiple finger tips of a user along with a thumb while the proximal end 106T can be anchored into the palm of a user allowing the distal end 104T and distal end 104B to be pinched solidly together by the user to provide added control and force when needed.

It has been yet further discovered that the flat bottom arm 202B can reduce manufacturing cost and complexity while simultaneously enhance the usability and stability of the applicator 102 by allowing the applicator 102 to sit flush on a surface without wobbling.

The curved structure of the distal end 104T of the top arm 202T is depicted tapering to a fine edge. The distal end 104T and the distal end 104B can converge together to a narrow wedge. The taper of the distal end 104T and the convergence of the distal end 104T and the distal end 104B can provide a fine maneuverable edge that facilitates the application of the eyelash strips of FIG. 4 with exacting detail near the base of the eyelash line of a user's eyelash.

The fine tip of the distal end 104T and the narrow converging wedge of the distal end 104T and the distal end 104B as depicted in the isometric side view of the present FIG. is contrasted by the large width of the distal end 104 depicted in the top view of FIG. 1. For maximum articulation and control the width of the distal end 104 shown from the top in FIG. 1 can be five times to eight times wider than a combination of the thickness of the distal end 104T and the distal end 104B. Further the width of the distal end 104 shown from the top in FIG. 1 can be the same as the length of the distal end 104T or the distal end 104B measured from the hinge 204 to their respective ends.

Figure 4:
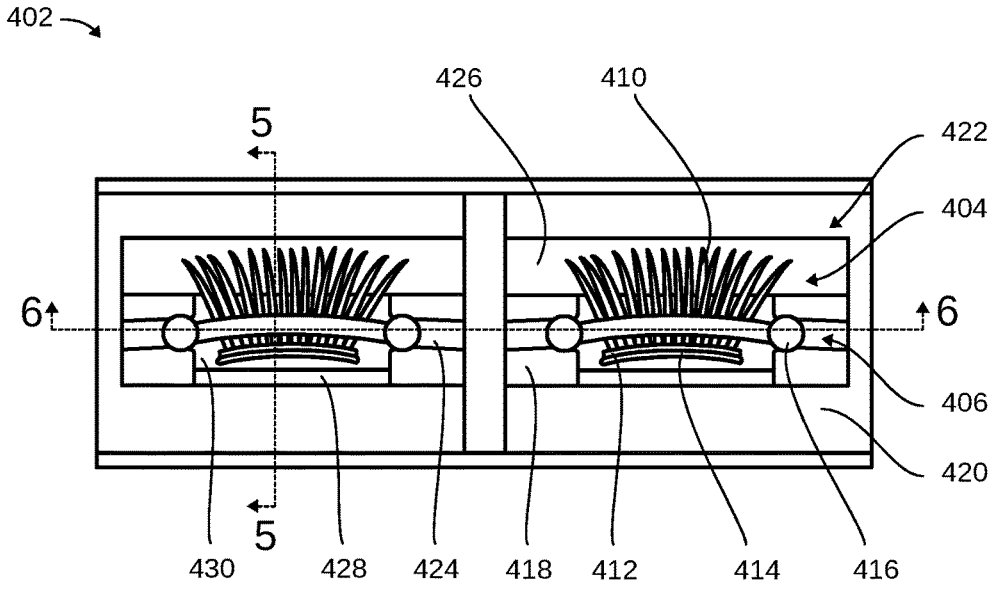
FIG. 4 is a top view of a cartridge for an embodiment of the eyelash application system.

It has been discovered that the combination of the distal end 104 having a large width shown in FIG. 1 in relation to the thickness of the distal end 104T and the distal end 104B as shown in FIG. 2 greatly enhances the maneuverability and stability in the hand of a user reducing the skill required to apply the eyelash strips of FIG. 4 since the entire top arm 202T and the bottom arm 202B are configured to be gripped comfortably as a handle. Because the expertise required to use the applicator 102 is greatly decreased, many people with little to no experience, including those with health issues that may need false eyelashes for the first time, are enabled with the eyelash application system.

Figure 3:
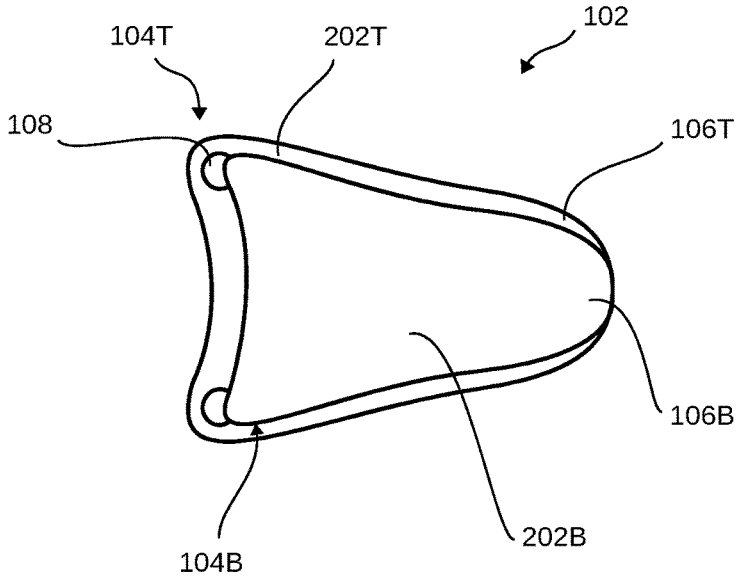
FIG. 3 is a bottom view of the applicator of FIG. 1.

Referring now to FIG. 3, therein is shown a bottom view of the applicator 102 of FIG. 1. The applicator 102 is depicted having the top arm 202T with the holes 108 in the distal end 104T.

The distal end 104B of the bottom arm 202B is depicted overhanging the holes 108 when in the closed configuration. The distal end 104B is further shown having a curve that follows the curve of the distal end 104T. The proximal end 106T and the proximal end 106B can terminate on a common plane.

Referring now to FIG. 4, therein is shown a top view of a cartridge 402 for an embodiment of the eyelash application system. The cartridge 402 is shown loaded with an eyelash strip 404. For descriptive clarity, the cartridge 402 can be considered in a loaded stage when the eyelash strip 404 is loaded within the cartridge 402.

Within the cartridge 402, a holder 406 can be removably attached. The holder 406 can include a curved crossbar 408.

The curved crossbar 408 of the holder 406 provides a platform for the eyelash strip 404 to be mounted and stored. The curved crossbar 408 can be curved with the same radius as the eyelash strip 404. The curved crossbar 408 can further be curved with the same radius as the distal end 104T of FIG. 3 and the distal end 104B of FIG. 3.

The eyelash strip 404 can include lashes 410, a band 412, and an adhesive 414. The lashes 410 can be mounted to the band 412 and extend out away from the band 412. The lashes 410 can fan out radially and be curved upward from a plane defined by the band 412.

The band 412 can be in direct contact with the adhesive 414. The adhesive 414 can cover the entire band 412 and extend beyond the ends of the band 412. It has been discovered that it is advantageous to not require a user to manually apply the adhesive 414 because it is easy for a user to apply more than required or to allow the adhesive 414 to contact an unsanitary surface. Providing the adhesive 414 already applied therefore increases uniformity of the adhesive 414 as well as ensuring a non-infectious adhesive 414 is used.

The eyelash strip 404 can be provided within the cartridge 402 as a one quarter, two thirds, or full eyelash strip 404. In some embodiments, it is contemplated that the eyelash strip 404 can be formed as a quarter or two thirds strip negating the need for a user to trim the eyelash strip 404.

Extending from either end of the curved crossbar 408 are pegs 416. The pegs 416 and the holes 108 of FIG. 1 can be mating structures with the pegs 416 mating to the holes 108 and thereby anchoring the holder 406 with the eyelash strip 404 onto the applicator 102 of FIG. 1.

The pegs 416 can be removably affixed to the cartridge 402 with peg anchors 418. The peg anchors 418 can extend vertically up away from and further than a middle surface 420. The middle surface 420 can include recesses 422 formed therein.

The eyelash strip 404 can be partially held within the recesses 422 underneath the curved crossbar 408 of the holder 406. The peg anchors 418 can extend up from the bottom of the recesses 422 past the middle surface 420.

The peg anchors 418 can include an applicator slot 424. The applicator slot 424 can enable the distal end 104T of FIG. 2 to fit therein allowing the holes 108 of FIG. 1 to slide onto the pegs 416 without requiring the holder 406 to be lifted out of the cartridge 402.

In one contemplated embodiment, the distal end 104T can be placed over the recesses 422 and into the applicator slot 424. The holes 108 of the applicator 102 of FIG. 1 can then snap onto the pegs 416. Once the pegs 416 are affixed or snapped into the holes 108, the holder 406 can be removed from the peg anchors 418 and lifted out of the cartridge 402.

The recesses 422 is depicted having sloped surfaces including a proximal sloped surface 426 and a distal sloped surface 428. The proximal sloped surface 426 can be the sloped surface that is closest to the proximal end 106 of FIG. 1 while the distal sloped surface 428 can be the sloped surface that is closest to the distal end 104 of FIG. 1 when the applicator 102 is attached to the holder 406 when removing the holder 406 from the cartridge 402.

The distal sloped surface 428 is depicted sloping down from the middle surface 420 to a bottom surface 430 of the recesses 422. The proximal sloped surface 426 is also shown sloping down from the middle surface 420 to the bottom surface 430 of the recesses 422.

The distal sloped surface 428 is shown with a steeper slope than the proximal sloped surface 426. The distal sloped surface 428 is also shown shorter than the proximal sloped surface 426. The peg anchors 418 can extend up from the bottom surface 430 of the recesses 422 near the end of the proximal sloped surface 426. The distal sloped surface 428 can be between the peg anchors 418. It is contemplated that the proximal sloped surface 426 can have a slope matching the curvature of the lashes 410.

Figure 5:
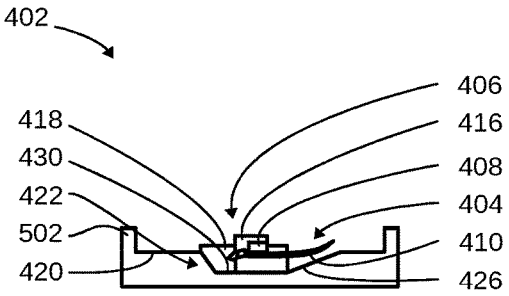
FIG. 5 is a cross-sectional view of the cartridge of FIG. 4 along the line 5-5.

Referring now to FIG. 5, therein is shown a cross-sectional view of the cartridge 402 of FIG. 4 along the line 5-5. The cartridge 402 is depicted having the eyelash strip 404 contained within the recesses 422.

The eyelash strip 404 is shown attached to the curved crossbar 408 of the holder 406. The pegs 416 are shown extending up from and attached to the curved crossbar 408. The pegs 416 of the holder 406 are removably coupled to the peg anchors 418, which are depicted extending up from the bottom surface 430 of the recesses 422.

The lashes 410 are depicted having a curvature that is followed by the proximal sloped surface 426 allowing the eyelash strip 404 to sit within the recesses 422 without contacting the surfaces of the recesses 422.

The cartridge 402 is further depicted having edge walls 502. The edge walls 502 can extend up from the middle surface 420 on either side of the cartridge 402 and can extend beyond the peg anchors 418 and the pegs 416. The edge walls 502 can seal the cartridge 402 when the cartridge 402 is stored for protecting the eyelash strip 404 and maintaining sanitary conditions of the eyelash strip 404 while stored.

Figure 6:
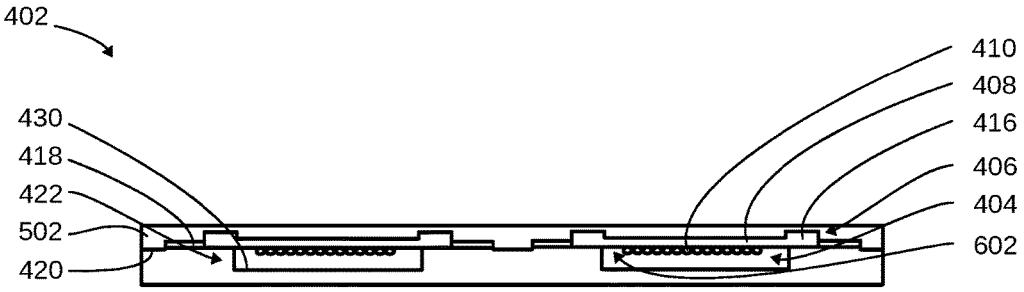
FIG. 6 is a cross-sectional view of the cartridge of FIG. 4 along the line 6-6.

Referring now to FIG. 6, therein is shown a cross-sectional view of the cartridge 402 of FIG. 4 along the line 6-6. The cartridge 402 is depicted having the eyelash strip 404 contained within the recesses 422.

The eyelash strip 404 is shown attached to the curved crossbar 408 of the holder 406. The pegs 416 extend up from and attached to the curved crossbar 408. The pegs 416 and the curved crossbar 408 have a coplanar bottom surface 602, both terminating on the same plane. The coplanar bottom surface 602 can be a flat surface extending between two of the peg anchors 418.

The coplanar bottom surface 602 can have the lashes 410 of the eyelash strip 404 attached thereto. The curved crossbar 408 is show having planar surfaces on the top and bottom and curved only when viewing the curved crossbar 408 from the top or bottom. The pegs 416 of the holder 406 are removably coupled to the peg anchors 418, which extend up from the bottom surface 430 of the recesses 422.

The cartridge 402 is further depicted having the edge walls 502. The edge walls 502 can extend up from the middle surface 420 on either side of the cartridge 402 and can extend beyond the peg anchors 418 and the pegs 416. The edge walls 502 can seal the cartridge 402 when the cartridge 402 is stored for protecting the eyelash strip 404 and maintaining sanitary conditions of the eyelash strip 404 while stored.

Figure 7:
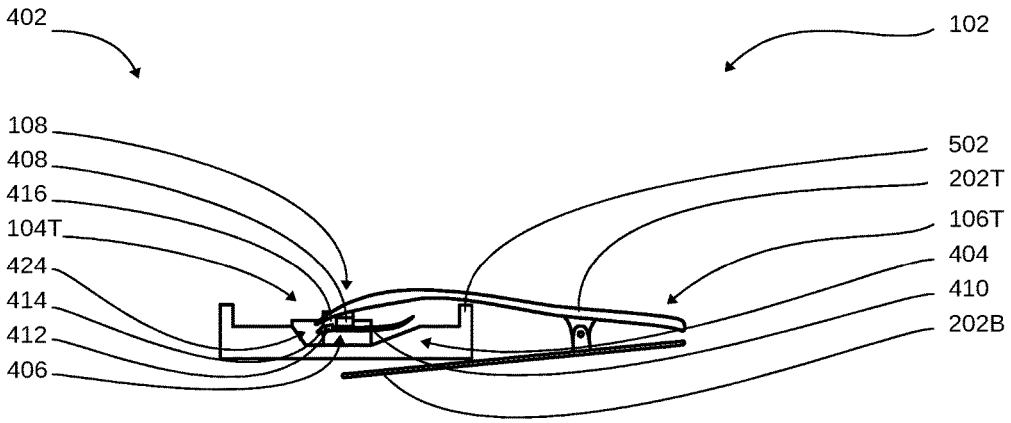
FIG. 7 is a side view of the applicator of FIG. 1 and the cartridge of FIG. 5 during an applicator loading phase of operation.

Referring now to FIG. 7, therein is shown a side view of the applicator 102 of FIG. 1 and the cartridge 402 of FIG. 5 during an applicator loading phase of operation. The top arm 202T of the applicator 102 is depicted over the cartridge 402 and extending into the cartridge 402 past the edge walls 502 and into the applicator slot 424.

The top arm 202T is shown covering the eyelash strip 404 with the lashes 410 pointing toward the proximal end 106T while the band 412 and the adhesive 414 is near the distal end 104T. The lashes 410 are depicted extending up toward the top arm 202T.

The top arm 202T is in direct contact with the pegs 416 of the holder 406 while the distal end 104T extends past a top of the curved crossbar 408. The holes 108 of the top arm 202T can be seen mated with the pegs 416. It is contemplated that when the holes 108 mate with the pegs 416, the mating action of the pegs 416 being inserted into the holes 108 can be accompanied by an audible and tactical click.

The audible and tactical click produced during the mating of the pegs 416 with the holes 108 has been discovered to provide an intuitive guide for a user that requires less expertise to ensure a proper placement of the holder 406 onto the applicator 102. Further it has been discovered that the large mating surface of the pegs 416 with the holes 108 provides a rigid connection between the applicator 102 and the holder 406 ensuring the holder 406 is properly angled every time for accurate placement of the eyelash strip 404 onto the users eyelid 904 of FIG. 9.

The bottom arm 202B can be seen extending below the cartridge 402 as the applicator 102 is in an open configuration. It is contemplated that the dimensions of the cartridge 402 can enable the applicator 102 to open fully so that the top arm 202T can mate with the holder 406 while not being impeded by the bottom arm 202B in contact with the cartridge 402.

Figure 8:
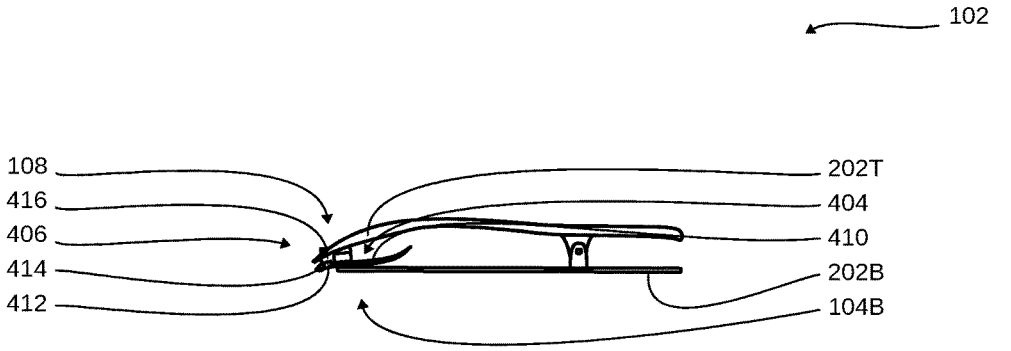
FIG. 8 is a side view of the applicator of FIG. 1 and the holder of FIG. 5 in an applicator loaded phase of operation.

Referring now to FIG. 8, therein is shown a side view of the applicator 102 of FIG. 1 and the holder 406 of FIG. 5 in an applicator loaded phase of operation. The applicator 102 is shown coupled to the holder 406 with the pegs 416 of the holder 406 extending through the holes 108 of the applicator 102.

The distal end 104B of the bottom arm 202B is in a clamped configuration in direct contact with the lashes 410 of the eyelash strip 404. The distal end 104B of the bottom arm 202B is further shown extending toward and close to the band 412 attaching the lashes 410. The distal end 104B is not depicted as covering the band 412 but can be pressed up against a side of the band 412 so that a lateral force can be applied to the band 412 when attaching the eyelash strip 404 to a user.

The adhesive 414 is depicted as exposed below the top arm 202T and the bottom arm 202B and spaced a small distance from the top arm 202T so that a user is encouraged to place the eyelash strip 404 at the proper angle and position on users eyelid 904 of FIG. 9. In other contemplated embodiments the bottom arm 202B can be in direct contact with a bottom portion of the band 412 for more ridged and secure hold of the eyelash strip 404 within the applicator 102.

Figure 9:
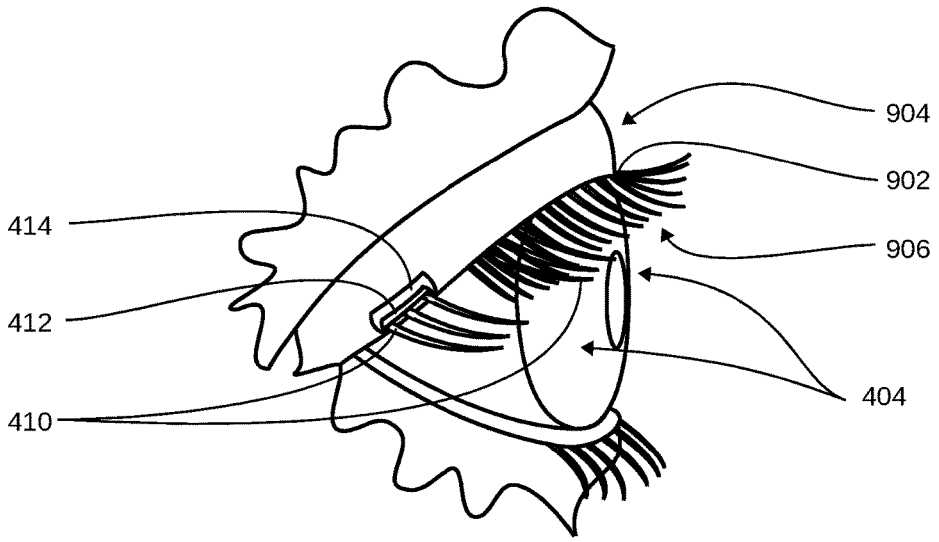
FIG. 9 is an isometric view of the eyelash strip after an attachment phase of operation.

Referring now to FIG. 9, therein is shown an isometric view of the eyelash strip 404 after an attachment phase of operation. The eyelash strip 404 is shown having the adhesive 414 in direct contact with a base 902 of a users eyelid 904. The adhesive 414 directly couples the base 902 with the band 412 holding the lashes 410.

Two ways of applying the eyelash strip 404 are depicted including one method applying the eyelash strip 404 above the eyelash 906 of the user. The other method depicted includes applying the eyelash strip 404 below the eyelash 906 of the user. When the eyelash strip 404 is attached below the eyelash 906 of the user, the band 412 and the adhesive 414 are not visible.

Figure 10:
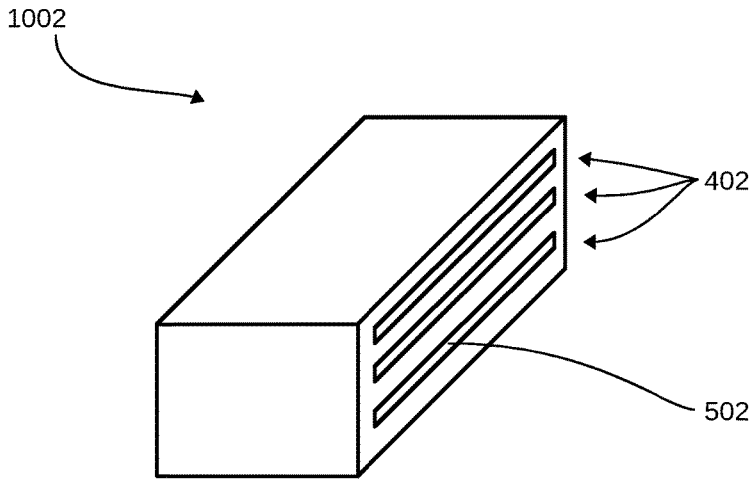
FIG. 10 is an isometric view of a case for the cartridges of FIG. 4 for an embodiment of the eyelash application system.

Referring now to FIG. 10, therein is shown an isometric view of a case 1002 for the cartridge 402 of FIG. 4 for an embodiment of the eyelash application system. The case 1002 is shown having multiple cartridges 402 contained within the case 1002. It is contemplated that the case can fasten releasably to the edge walls 502 of the cartridge 402 for a secure storage.

It is further contemplated that the case 1002 can provide a sterile environment, an air-tight environment, or a combination thereof for the eyelash strip 404 of FIG. 4 attached to the cartridge 402. It is contemplated the case 1002 can provide organization for the cartridge 402 based on the type, length, or color of the lashes 410 of FIG. 4.

Thus, it has been discovered that the eyelash application system furnishes important and heretofore unknown and unavailable solutions, capabilities, and functional aspects. The resulting configurations are straightforward, cost-effective, uncomplicated, highly versatile, accurate, sensitive, and effective, and can be implemented by adapting known components for ready, efficient, and economical manufacturing, application, and utilization.

While the eyelash application system has been described in conjunction with a specific best mode, it is to be understood that many alternatives, modifications, and variations will be apparent to those skilled in the art in light of the preceding description. Accordingly, it is intended to embrace all such alternatives, modifications, and variations, which fall within the scope of the included claims. All matters set forth herein or shown in the accompanying drawings are to be interpreted in an illustrative and non-limiting sense.

What is claimed is:

1. An eyelash application system comprising:

a cartridge including a recess;

a holder releasably affixed above the recess of the cartridge, the holder including a curved crossbar and a peg extending vertically past the curved crossbar;

an eyelash strip having a lash attached to the curved crossbar of the holder; and an applicator having a top arm with a hole, the hole sized and position within the top arm to align and mate with the peg of the holder based on the applicator being in a loading phase of operation.

2. The system of claim 1 wherein the cartridge includes a peg anchor having an applicator slot sized and positioned to align with a distal end of the top arm of the applicator based on the applicator being in a loading phase of operation.

3. The system of claim 2 wherein the holder is releasably affixed to the peg anchor, and the peg anchor formed within the recess of the cartridge.

4. The system of claim 1 wherein:

the cartridge includes an edge wall and a middle surface extended laterally from the edge wall; and the recess extended down from the middle surface.

5. The system of claim 4 further comprising a case; and wherein:

the middle surface is contained within the case; and the edge wall is exposed from a side of the case.

6. A method of manufacturing an eyelash application system comprising:

providing a holder including a curved crossbar and a peg extending vertically past the curved crossbar;

attaching an eyelash strip to the curved crossbar of the holder; and providing an applicator having a top arm with a hole, the hole sized and position within the top arm to align and mate with the peg of the holder based on the applicator being in a loaded phase of operation.

7. The method of claim 6 further comprising:

providing a cartridge including a recess; and wherein:

providing the holder includes releasably affixing the holder above the recess of the cartridge; and attaching the eyelash strip includes attaching a lash of the eyelash strip to the curved crossbar of the holder.

8. The method of claim 7 wherein providing the cartridge includes providing the cartridge having a peg anchor with an applicator slot sized and positioned to align with a distal end of the top arm of the applicator based on the applicator being in a loading phase of operation.

9. The method of claim 8 wherein releasably affixing the holder includes releasably affixing the holder to the peg anchor, and the peg anchor formed within the recess of the cartridge.

10. The method of claim 7 wherein providing the cartridge includes providing the cartridge having an edge wall and a middle surface extended laterally from the edge wall, and the recess extended down from the middle surface.

11. The method of claim 10 further comprising providing a case; and mounting the cartridge in the case with the middle surface is contained within the case, and the edge wall exposed from a side of the case.

* * * * *